US006513596B2

(12) United States Patent
Wester

(10) Patent No.: US 6,513,596 B2
(45) Date of Patent: Feb. 4, 2003

(54) NON-INTRUSIVE PRESSURE MEASUREMENT DEVICE FOR SUBSEA WELL CASING ANNULI

(75) Inventor: Randy J. Wester, Spring, TX (US)

(73) Assignee: FMC Technologies, Inc., DE (US)

( * ) Notice: Subject to any disclaimer, the term of this patent is extended or adjusted under 35 U.S.C. 154(b) by 30 days.

(21) Appl. No.: 09/776,065

(22) Filed: Feb. 2, 2001

(65) Prior Publication Data

US 2001/0027865 A1 Oct. 11, 2001

Related U.S. Application Data

(60) Provisional application No. 60/179,810, filed on Feb. 2, 2000.

(51) Int. Cl.[7] ..... E21B 47/06

(52) U.S. Cl. ..... 166/336; 166/250.07; 166/337; 166/66

(58) Field of Search ..... 166/336, 337, 166/250.01, 250.07, 66

(56) References Cited

U.S. PATENT DOCUMENTS 3,974,690 A * 8/1976 Brock et al. ..... 73/152.51
4,116,044 A * 9/1978 Garrett ..... 285/93
4,202,410 A * 5/1980 Quebe ..... 166/88.4
4,230,187 A * 10/1980 Seto et al. ..... 137/458
4,887,672 A 12/1989 Hynes
5,172,112 A 12/1992 Jennings et al.
5,295,534 A 3/1994 Porter
5,366,017 A 11/1994 Voss
5,492,017 A 2/1996 Jennings et al.
5,544,707 A 8/1996 Hopper et al.

* cited by examiner

*Primary Examiner*—Hoang Dang
(74) *Attorney, Agent, or Firm*—James L. Jackson; Andrews & Kurth, LLP

(57) ABSTRACT

A well data monitoring system which enables annulus pressure and other well parameters to be monitored in the outer annuli of the well casing program without adding any pressure containing penetrations to the well system. This non-intrusive approach to monitoring pressure and other well parameters in the annuli preserves the pressure integrity of the well and maximizes the safety of the well. In the preferred embodiment an intelligent sensor interrogation system which can be located externally or internally of the pressure containing housing of the wellhead is capable of interrogating and receiving data signals from intelligent well data sensors which are exposed to well parameters within the various annuli of the well and wellhead program.

8 Claims, 6 Drawing Sheets

NON-INTRUSIVE PRESSURE MEASUREMENT DEVICE FOR SUBSEA WELL CASING ANNULI

Applicant hereby claims the benefit of United States Provisional Application Serial No. 60/179,810 filed on Feb. 2, 2000 by Randy J. Webster, entitled "Pressure Measurement Device for Subsea Well Casing Annuli", which provisional application is incorporated herein by reference for all purposes.

BACKGROUND OF THE INVENTION

1. Field of the Invention

The present invention pertains generally to wells for production of petroleum products and more specifically concerns wells located in a subsea environment where the pressure containing integrity of wells is of particular concern from the standpoint of environmental protection and for protection of workers and equipment from the hazards of pressure leakage from wells. More particularly, the present invention provides a non-intrusive method for monitoring pressure in well casing annuli without compromising the pressure containing integrity of the well system in any way, and thus permitting excessive pressure in typically inaccessible annuli to be detected, and corrective actions taken before a hazardous event can occur that might impact human life, the environment or property.

2. Description of the Prior Art

While the present invention has application to petroleum producing wells other than subsea well systems, for purposes of simplicity and to facilitate ready understanding of the invention by others, the present invention is described herein particularly as it relates to subsea wells.

The Minerals Management Service (MMS) recently revised its policy on Sustained Casinghead Pressure (SCP) for the Gulf of Mexico Outer Continental Shelf Region (GOMR). The MMS issued a proposed Notice to Lessees and Operators (NTL) to define changes that are forthcoming to its current policy. Current (previous) policy is defined in a Jan. 13, 1994 Letter to Lessees (LTL).

SCP occurs when one or more leaks develop in the barriers designed to achieve and maintain pressure control of wells. SCP is defined as:

1. A pressure measurable at the casinghead of a casing annulus that rebuilds when bled down;
2. A pressure that is not due solely to temperature fluctuations; and
3. A pressure that has not been deliberately applied.

It is thus considered desirable to monitor all casing annuli for SCP on all subsea trees to ensure early detection of pressure buildup in any of the various annuli thereof.

The Jan. 13, 1994 LTL required all annuli on offshore producing wells to be monitored for SCP. However, this regulation is written primarily for wells on conventional, fixed platforms and departures have been granted for subsea wells. The accepted requirement for subsea wells is to monitor only the annulus between the production tubing and production casing strings (the "A" annulus) since it can be monitored by pressure sensing lines passing through the wellhead, without any need for penetrating the outer pressure containing housing or wall which isolates annulus pressure from the seawater or other environment. The conventional method for monitoring the "A" annulus is to provide an annulus monitor line in the tree's production control umbilical and/or to provide an electronic pressure sensor in the tree's annulus flowpath. The control line and/or pressure sensor can be isolated from the production annulus of the well by one or more valve closures on the subsea tree. Wells with SCP in the "A" annulus that is less than 20% of the minimum internal yield pressure (MIYP) of the affected casing can be produced on a "self approved" basis, provided the annulus pressure can be bled to zero through a ½" needle valve in 24 hours or less. Criteria is also established to determine unsustained casing pressure that is typically caused by thermal Ad effects during well start up.

Surface wellhead systems, used on land and on offshore platforms, provide pressure containing side outlets in the casing and tubing heads, from which annulus pressure can be monitored. API Specification 17D does not permit body penetrations in high pressure subsea wellhead housings. Even if penetrations were allowed in subsea wellhead, housings, the overall safety of the well would be at higher-risk because each wellhead penetration creates a potential leak point. Obviously when a wellhead is located at or near the seabed leakage or a body penetration connection would be difficult to detect until a major problem has occurred.

In 1995, a laboratory demonstration was provided for a non-intrusive wellhead casing monitoring system to the Deepstar Joint Industry Project. This non-intrusive annulus pressure monitoring system uses strain gauges on the outside of the wellhead housing. The elevation of the strain gauges on the wellhead corresponds to the annular areas between the casing hanger packoffs inside the wellhead housing. Pressure is monitored by correlating the strain measured on the outside of the wellhead housing to the pressure applied between the packoffs inside the wellhead housing. The strain gauge method has not progressed beyond the laboratory stage due to technical concerns about implementing the method for the subsea environment.

U.S. Pat. No. 5,544,707, dated Aug. 13, 1996, covers an adjustable seal sleeve mechanism that can be installed in the place of a normal packoff assembly on the production casing hanger to provide access to the annulus around the outside of the production casing (the "B" annulus). The position of the sleeve is adjusted mechanically by a running tool prior to installing the tree. When the tree is installed, pressure in the "B" annulus can be monitored separately from pressure in the production tubing annulus (the "A" annulus) through a side outlet in the tree body. Monitoring of the "B" annulus is achieved by conventional means, in the same manner as described above under current practice for the "A" annulus. The adjustable-sleeve approach only enables pressure to be monitored in the innermost two annuli of a well. Some subsea wells with extensive casing programs may have up to six annuli. The seals and ports on the adjustable sleeve are potential leak points that increase the overall safety risk for the well.

U.S. Pat. No. 4,887,672 covers a method that uses hydraulic couplers between the top of wellhead housing and the tree connector. The couplers enable ports in the wellhead and tree to communicate with each other when the tree is locked to the wellhead. A long vertical hole drilled from the coupler location in the top of the wellhead communicates with a short, internal, horizontal hole in the wellhead housing. The elevation of the internal hole exposes the annular area between casing hanger packoffs to the monitoring port. One coupler/port combination is used for each annulus to be monitored. The ports can be monitored through a line in the production umbilical and/or by an electronic pressure sensor, per current practice. The hydraulic coupler method is not believed to have been installed in the field. Orientation of the couplers prior to tree/wellhead makeup is critical and the couplers are subject to damage. Each port is a potential leak point that increases the overall safety risk for the well.

The Minerals and Management Service (MMS) of the U.S. Department of the Interior has proposed that wells with subsea trees will need to have all casing annuli monitored for sustained casing pressure, beginning with trees installed after Jan. 1, 2005. This requirement may present a safety risk to subsea wells, because the most straightforward method of accessing an annulus for pressure monitoring is to make a pressure containing penetration through the body of the pressure vessel. Since it is well known that all penetrations through the outer pressure containing housing of wellheads are potential leak points which add sealing risk, and thus safety risk, to the well system pressure monitoring in all well annuli will not be practical unless a safe system for doing so becomes commercially available. A further complication is that API Specification 17D for Subsea Wellhead and Christmas Tree Equipment explicitly prohibits body penetrations in high pressure subsea wellhead housings. Therefore, the recommended method for monitoring pressure in multiple annuli is by non-intrusive means, which does not exist according to current practice. It is to this need that the present invention is addressed.

The GOMR will not grant departures to allow pressure on the outside casings of subsea wells drilled or sidetracked after the effective date of the proposed NTL unless the lessee/operator can document in their Application for Permit to Drill (Form MMS 123) or Sundry Notice (Form MMS 124) that best cementing practices will be used. Proposed best cementing practices are defined by the MMS in Appendix B of the proposed NTL. This policy applies to all conductor, surface, intermediate and production casings. Pressure must be able to be detected at all times. For subsea wells, where only the production annulus can be monitored, diagnostics must be conducted as indicated in Appendix A of the proposed NTL, except that results for adjacent annuli will be restricted to monitoring tubing pressure response. That requirement is understood to mean that access must be provided to the "A" annulus as per current practice, and additional means must be provided to measure, but not bleed down or build up, the pressure in all outer annuli.

The objective for monitoring SCP on all annuli must be clearly established before a change in practice is implemented, to ensure that any change achieves the desired result. The implied objective is to eliminate safety hazards, and thereby avoid harm or damage to human life, the marine and coastal environment, and property. Therefore, the perceived advantages associated with monitoring SCP on all annuli must be achieved without increasing the risk or decreasing the reliability of current practice. Otherwise, well safety may be compromised rather than improved.

Before the proposed practice of monitoring SCP on/all casing annuli is implemented, concerns of safety, reliability and cost must be fully addressed. Wells are safe if pressures are known and controlled in a reliable manner.

There are two potential sources of SCP. The first source is from produced fluids coming out of the reservoir; the second is from formation pressure above the reservoir. If SCP results from produced fluids, due to a packer or tubing leak for example, it will be detected in the "A' annulus first. Current practice enables monitoring of SCP in the 'A' annulus, so the proposed practice of monitoring SCP in all casing annuli provides no additional benefit for the first source of SCP. If SCP results from formation pressure, the most likely causes are cement or structural failures. Rigorous implementation of properly engineered and designed cementing operations should minimize the risk of cement related failures. Universally accepted "best cementing practices" may come from the MMS, as described in Appendix B of the proposed NTL, or they may come from industry. Well casing programs and subsea wellhead equipment are structurally designed to control formation pressure in the outer casing annuli in a safe and reliable manner. Therefore, the need to monitor SCP in all casing annuli is questionable and should only be considered if a highly reliable means of achieving it can be established.

The reliability of any new SCP monitoring system should be equal to or better than current practice, otherwise, well safety may be compromised. The only methods that can be considered equally reliable to current practice are non-intrusive methods. Non-intrusive methods provide a means to monitor SCP without adding any new pressuring containing penetrations (intrusions) to the subsea wellhead housing or casing hanger systems. Every penetration is a potential leak point that decreases reliability. All intrusive methods add leak points, either externally through the wellhead housing or internally through movable seals on the casing hangers. Even though non-intrusive methods do not add leak points, their reliability at this point in time is unknown because non-intrusive methods are not fully developed and field proven. The reliability of the pressure data gathered by a non-intrusive system must be highly accurate, because the status of the well and important operational decisions will be based on the data acquired.

The cost associated with implementing a/multi-annulus pressure -monitoring system will depend on the method employed. Since the recommended method is a non-intrusive approach, and functional, field proven, non-intrusive methods do not exist at this time, the cost of implementation cannot be accurately estimated. However, the cost will be significant because wellhead systems, control systems and production umbilicals will all be impacted. The additional cost may preclude developing wells that are already considered economically marginal. For wells that are produced, a portion of the additional cost will have to be incurred during the drilling phase of a project, because the wellhead system will have to be equipped to interface with an SCP monitoring system.

SUMMARY OF THE INVENTION

The invention provides a non-intrusive method for monitoring pressure in well casing annuli. The pressure containing integrity of the well system is not compromised in any way. The overall safety of the well is enhanced because excessive pressure in a previously inaccessible annuli can be detected, and corrective actions can be taken by the well operator, before a hazardous event occurs to human life, the environment or property.

The annuli between subsea well casings need to be monitored for pressure to ensure the well is being operated in a safe manner and to satisfy regulatory requirements. Traditionally, only the annulus between the production tubing and production casing string is monitored for pressure for wells drilled through marine wellheads. New regulatory requirements may dictate that all casing annuli be monitored for pressure in the future. The present invention enables pressure to be monitored in the outer annuli of the well casing program without adding any pressure containing penetrations to the well system. This non-intrusive approach to monitoring pressure in the annuli preserves the pressure integrity of the well and maximizes the safety of the well.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic sectional illustration of a wellhead system of a conventional well, and which is typical of subsea Christmas trees, showing a system for monitoring pressure in the annulus between the production tubing and the production casing string (the "A" annulus) and being representative of the prior art;

Figure 1:
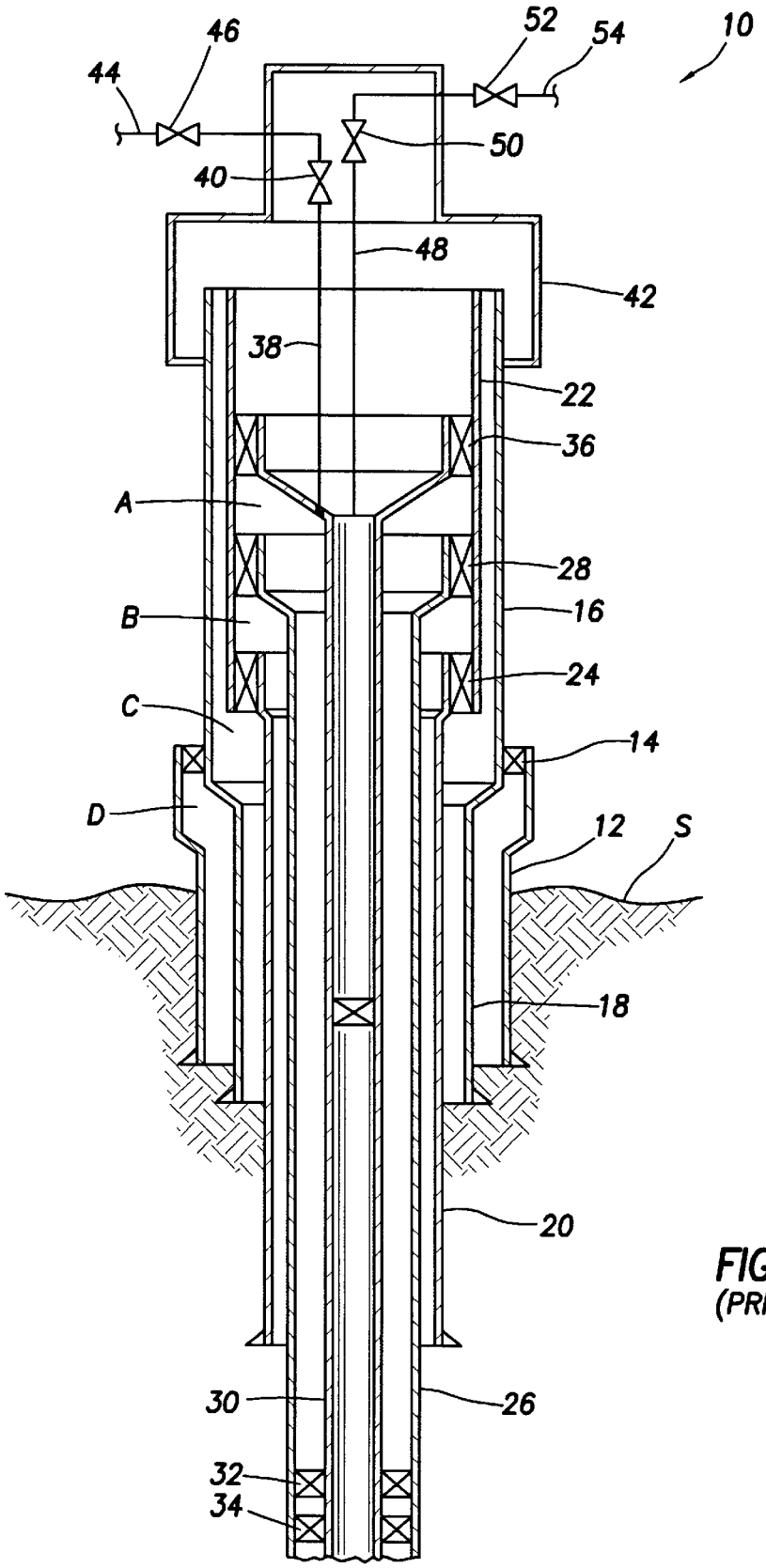
FIG. 1 (PRIOR ART)
Figure 2:
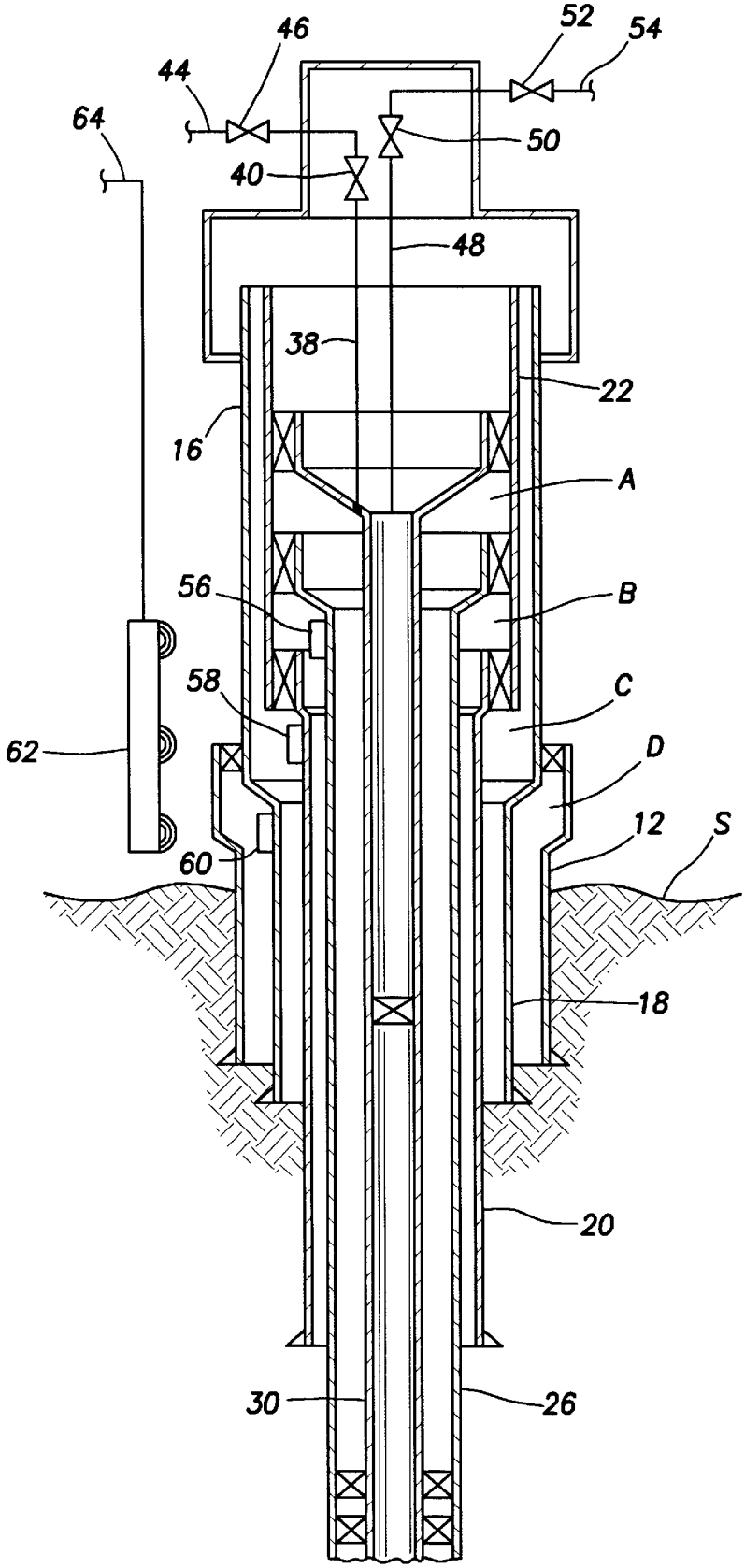
Figure 3:
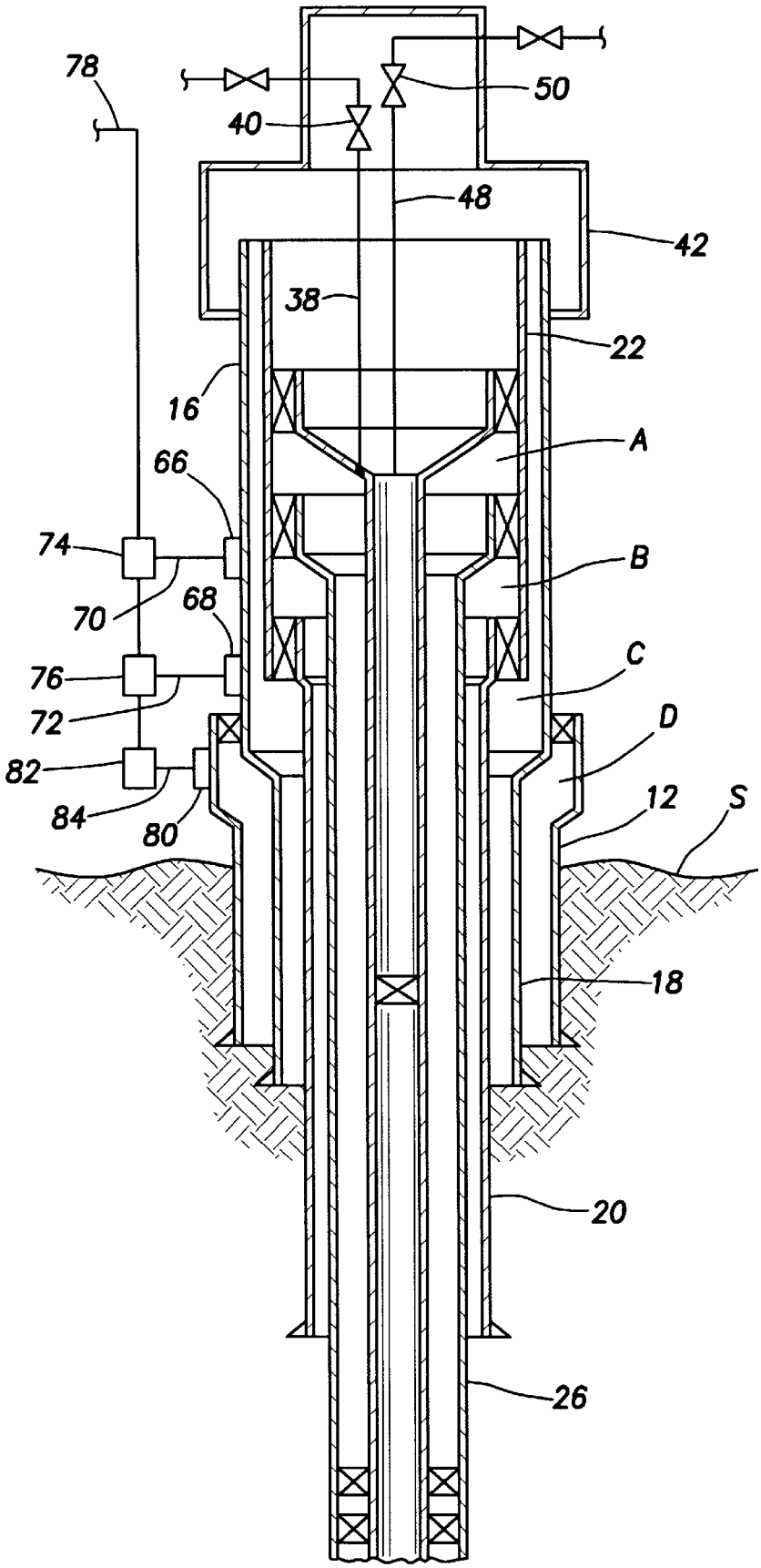
Figure 4:
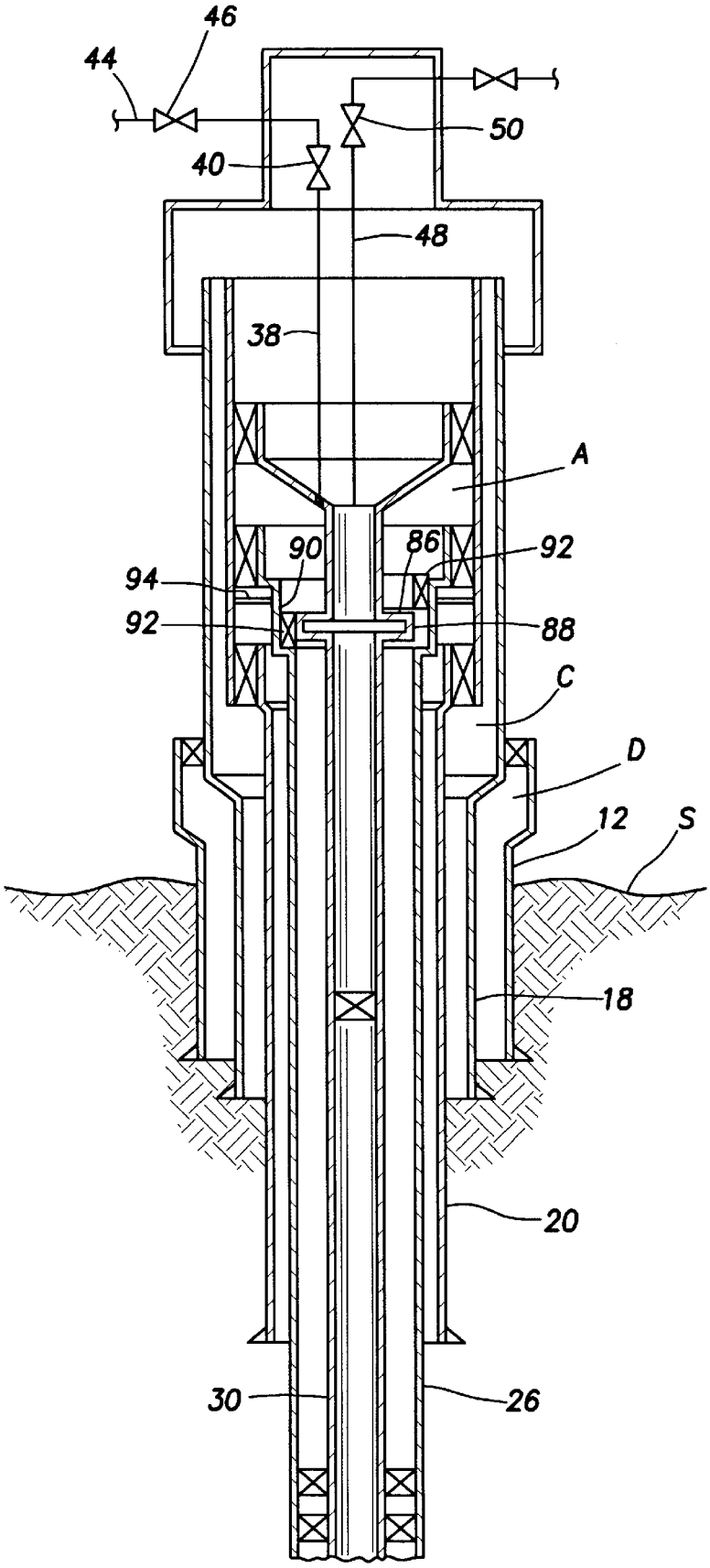
Figure 5:
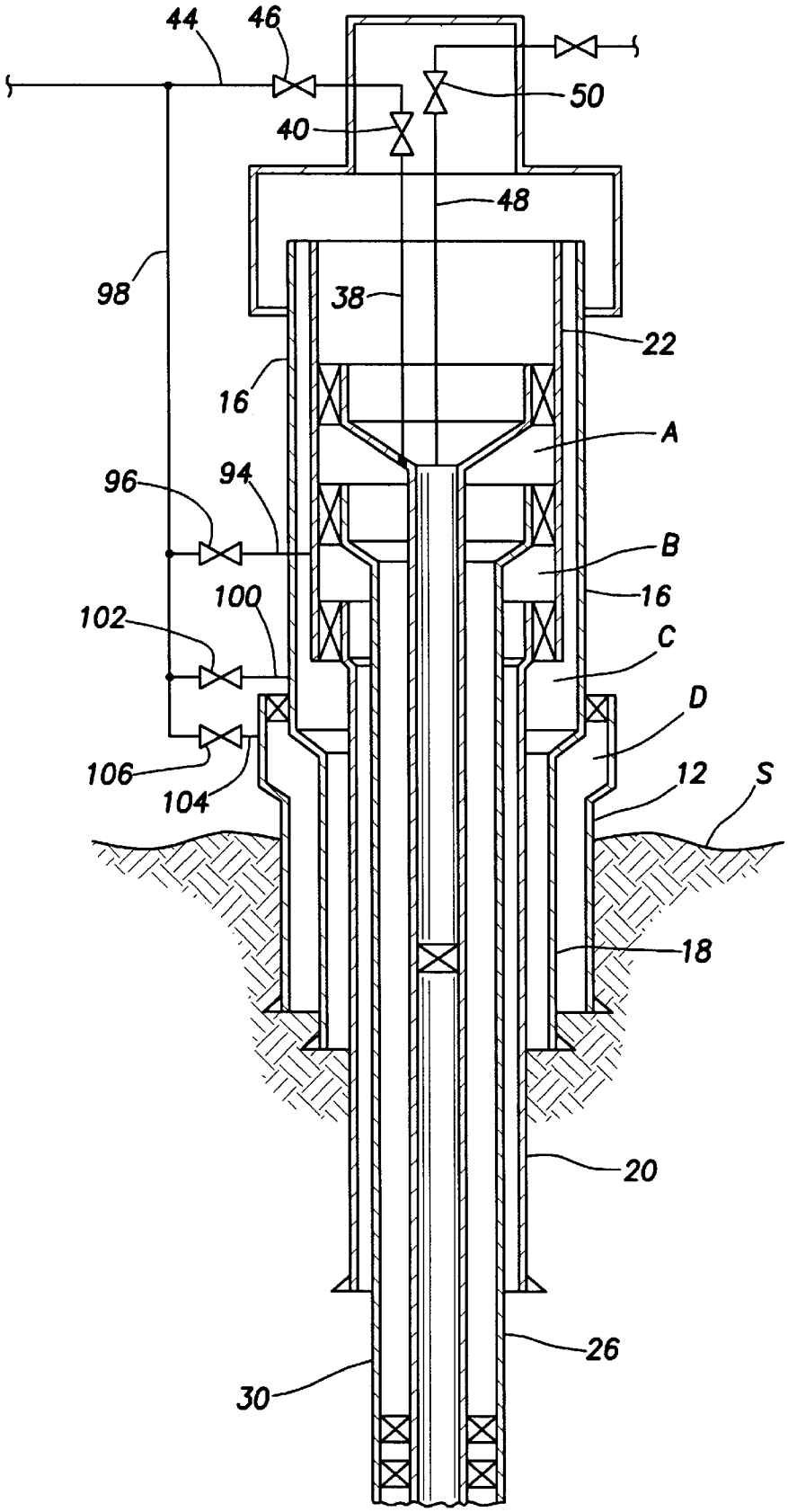
Figure 6:
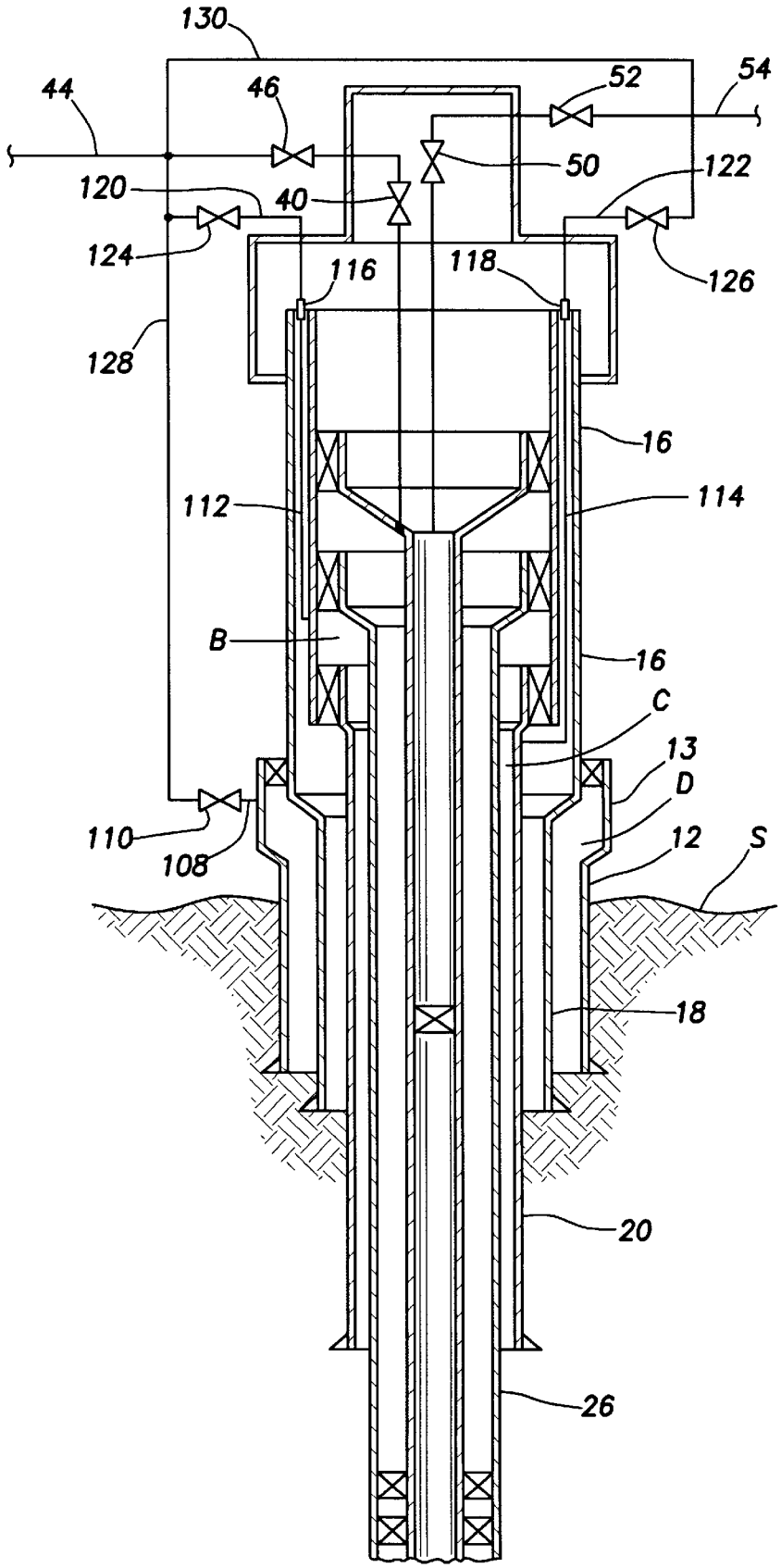

FIG. 2 is a schematic sectional illustration of a subsea tree having a conventional annulus pressure monitoring system as in FIG. 1 and additionally having a non-intrusive system according to the principles of the present invention, with an intelligent sensor interrogation device mounted externally on the wellhead and intelligent sensors mounted for monitoring pressure in all annuli and representing the preferred embodiment of the invention;

FIG. 3 is a schematic sectional illustration of a subsea tree similar to that of FIG. 2 and depicting an alternative embodiment of the present invention being a non-intrusive pressure measurement system having strain gauges mounted on the wellhead housing structure and with a wellhead mounted strain measurement device interconnected therewith for detecting conditions of strain and thus detecting conditions of internal pressure within selected annuli;

FIG. 4 is a schematic sectional illustration of a subsea tree having a conventional annulus pressure measurement system and illustrating another embodiment of the present invention incorporating a sliding sleeve located in the production casing hanger and being moveable between a position monitoring pressure in annulus "A" and a position monitoring pressure in annulus "B";

FIG. 5 is a schematic sectional illustration of a subsea tree having a conventional annulus pressure measurement system and illustrating an intrusive pressure measurement embodiment of the present invention incorporating side outlet wellhead penetrating elements in communication with selected annuli and valve controlled conduits for controlling communication of selected annulus pressure to an annulus monitor line; and FIG. 6 is a schematic sectional illustration of a subsea tree having a conventional annulus pressure measurement system and representing another embodiment of the present invention and having annulus pressure communicating passages internally of the high pressure housing which are in communication with selected annuli and with hydraulic couplers connecting the pressure communicating passages with respective annulus pressure communication lines of the annulus pressure monitoring system of the well.

DETAILED DESCRIPTION OF PREFERRED EMBODIMENT

FIG. 1 of the Drawings schematically illustrate a wellhead having multiple annuli and showing a conventional system representing the prior art for detecting pressure conditions within the production tubing outlet at the tubing hangar and detecting pressure conditions within annulus "A". The pressure measurement system of FIG. 1 is of non-intrusive nature but it does not have the capability for measuring the pressure of other annuli.

FIG. 2 of the Drawings illustrates a non-intrusive pressure monitoring system for well casing annuli, representing the preferred embodiment of the present invention that consists of intelligent pressure sensors mounted on the casing hangers and/or casing strings and a means to remotely interrogate those sensors. The interrogation device may be located external to the wellhead or may be located internal to the wellhead on or within the completion tubing hanger or tubing string. The invention does not require any penetrations through the high or low pressure wellhead housings, casing hangers or casing strings. Penetrations through the tubing hanger, per current practice, may be maintained. For wells with multiple casing strings and thus multiple annuli, the pressure sensors are capable of being interrogated through multiple casing wall sections.

The primary intent of the invention is to provide pressure data from the casing annuli without introducing intrusive, pressure containing penetrations and associated potential leak points into the well system. However, the intelligent sensors are not limited to providing pressure data. Other relevant well data, such as temperature or other information, may be provided by the sensors.

The sensors will need a power supply to perform their function. The power supply may be a battery that is part of the sensor system. The battery may be pulsed on and off by the interrogation signal to provide long life. Multiple battery sets that are activated by different signals may be utilized sequentially to provide even longer life, i.e., use one battery until it depletes, then activate another, previously unused battery. Alternatively, power and signal may be transmitted through the wellhead, casing hanger and/or casing, as applicable, to the sensor. The sensors may utilize fiber optics, electromagnetism, strain gauges, x-rays, gamma rays, acoustics, memory metals, or other means to perform their function.

The sensor interrogation device may be fixed to the wellhead housings or subsea tree, or it may be mounted on the wellhead housings or subsea tree in a manner that permits it to be remotely installed and/or retrieved by diver, by ROV or by other type of remote intervention means. The sensor interrogation device may also be deployed within the well bore as part of the completion tubing string assembly. The interrogation device could then be removed and replaced by pulling the tubing string. Alternatively, the interrogation device could also be suspended inside the production tubing string in a manner that permits it to be retrieved by wireline or coiled tubing intervention, to avoid having to pull the tubing string.

Power and signal to the sensor interrogation device may be supplied through conductors in the production umbilical and through conductive or inductive couplers at the appropriate interfaces. Power may also be provided by a battery that is part of the sensors or the interrogation device. Signals may then be transmitted acoustically, or by other non-conductive means. The data gathered by the interrogation device is transmitted to a control system for processing and readout.

Referring now to the Drawings and first to FIG. 1, the schematic sectional illustration depicts a conventional subsea tree, shown generally at 10 having a conventional annulus pressure monitoring system for monitoring pressure in annulus "A" and being representative of the prior art. The well construction comprises a conductor pipe 12 which penetrates the surface formation to a desired depth and which is cemented to the surface formation. The upper end of the conductor pipe is sealed by a packer 14 to a high pressure containing housing 16 connected to surface casing 18 and forming the outer pressure containing housing of a wellhead or "tree". The outer pressure containing housing 16 is connected to the upper end of surface casing 18 which is also cemented to the earth formation. The conductor pipe 12, the housing 16 of the surface casing 18 and the packer 14 cooperate to define an annulus "D". Normally in subsea conditions the pressure conditions of annulus "D" is not measured because to do so would require penetration of the conductor pipe by a pressure monitoring connection. An intermediate casing 20 extending through the surface casing 18 and also being cemented to the earth formation, has a pressure containing housing 22 at its upper end forming a pressure containing component of the wellhead. The intermediate casing and its housing 22 represent a pressure containing partition internally of the outer pressure containing housing 16 and, being concentrically spaced within the outer housing, define an annulus "C". The intermediate casing is sealed internally of the housing 22 by a packer 24 and a production casing 26 extending to the depth of the production formation is sealed to the housing 22 by a packer 28. An annulus "B" is defined between the intermediate end production casings 20 and 26 and is isolated by packers 24 and 28. Production tubing 30, which may also extend to the depth of the production formation is sealed to the production casing at its lower end by packers 32 and 34 and is sealed at its upper end to the housing 22 by one or more packers 36.

Within the pressure containing housing 22 and below the tubing hanger and the packer 36 an annulus, typically referred to as annulus "A" is defined. Annulus "A" comprises the space between the production casing 26 and the production tubing 30 and isolated between packers 28 and 36. Conventional practice permits annulus "A" to be monitored while annuli B, C, D, etc. are typically not monitored. According to current practice the pressure within annulus "A" is measured by a pressure measurement line 38 which has its lower end in communication with annulus "A" as shown. Pressure measurement communication via pressure measurement line 38 is controlled by a valve 40 which is provided on the subsea tree structure 42. A production annulus monitor line 44 is connected with the pressure measurement line 38 across a control valve 46, thus permitting annulus pressure measurement of annulus "A" to be selectively controlled. A production conduit 48 is in communication with the production tubing and is controlled by valves 50 and 52 to permit the flow of production fluid through a production outlet 54. Production pressure can be easily measured via the conduct 48 either upstream or downstream of the valves 50 and 52.

With conventional annulus pressure monitoring as shown in FIG. 1 only the pressure within annulus "A", the production annulus, is capable of being monitored. In such case, the condition of pressure within annuli "B", "C" and "D " is not known. Thus, in the event leakage of any well component, such as a packer, conduit joint, seal, etc. should be occurring, it will not become immediately apparent to the personnel in charge of the well. This, of course, can lead to a condition where a pressure containing component can fail, potentially releasing pressurized petroleum products not only to the environment but also to an area that might be occupied by personnel. When the pressure conditions of the annuli "B", "C" and "D" are known, in the event any annulus pressure condition should change and is considered to represent a potentially hazardous condition, the well can be shut in or repair operations can be scheduled so that the pressure containing integrity of the well can be efficiently maintained at all times.

Obviously, knowledge of the pressure conditions within the annuli "B", "C" and "D" of a wellhead system are important factors to enable maintenance of the pressure containing integrity of the wellhead system as well as other well components. Consequently, there is significant interest on the part of industry and government in providing wells, especially subsea wells, with systems for monitoring pressure within most, if not all of the various annuli thereof. Though the pressures of the various annuli of wellheads can be monitored if penetration of the pressure containing housings and components of wells can be penetrated by pressure monitoring passages and lines, in the subsea environment outer housing penetration for annuli pressure measurements is not a viable option. As mentioned above, it is considered improper and potentially dangerous and hazardous practice to penetrate wellhead components for the purpose of accessing the various annuli for pressure monitoring. Consequently, the present invention provides an effective solution to the problem of annuli pressure monitoring and yet permits maintenance of the pressure containing integrity of all well components.

With reference now to FIG. 2, a preferred embodiment of the present invention is presented in conjunction with a schematic illustration of a well system shown in section. The basic well system is substantially the same as presented in FIG. 1, thus like reference numerals appear for like components. The pressure monitoring system for the well includes a conventional production annulus pressure monitoring system as described above in connection with FIG. 1. An intelligent pressure sensor 56 is mounted externally of the production casing 26 and is preferably located within the high pressure wellhead structure. The sensor 56 is located in communication with annulus "B" and thus senses the pressure therein. An intelligent pressure sensor 58 is mounted externally of the intermediate casing 20 and in position for sensing the pressure within annulus "C". Likewise, another intelligent pressure sensor 60 is mounted externally of the surface casing 18 and is positioned for sensing the pressure within annulus "D".

An intelligent sensor interrogation device 62 is located externally of an annulus within which an intelligent pressure sensor is located and it and the intelligent sensor or sensors have the capability for communicating pressure signals and interrogation signals through the wall structure of the pressure containing housing or other wellhead component. Thus, without penetrating the pressure containing housing with an intrusive pressure monitoring passage, pressure signals from intelligent pressure sensors located within each of the annuli to be monitored enable fluid pressure within selected annuli to be readily obtained. The pressure signals received by the intelligent sensor interrogation device 62 are then communicated via one or more outer annulus monitor lines or conductors to a receiver which may be located on a production platform. Any unusual annulus pressure that is detected can immediately be identified as to potential cause, and appropriate action can be taken to service the well system or shut the well in until repairs can be made, thus ensuring maintenance of the safety and integrity of the well.

The intelligent sensors and the intelligent sensor interrogation device may utilize technology such as fiber optics, electromagnetism, strain gauges, x-rays, gamma rays, acoustics, memory metals and other means to accomplish data sensing and transmission through the wall structure of the wellhead with necessitating penetration of the wellhead by sensor connectors.

Referring now to FIG. 3, an alternative embodiment of the present invention is presented in conjunction with a schematic illustration of a well system shown in section. The basic well system is substantially the same as presented in FIG. 1, thus like reference numerals appear for like components. The pressure monitoring system for the well includes a conventional production annulus pressure monitoring system as described above in connection with FIG. 1. Strain gauges 66 and 68 are mounted in strain measuring condition on the outer surface and at strategic locations, such as regions between internal packers, on the outer pressure containing housing 16 of the high pressure wellhead. In the event of pressure increase or decrease within annuli "B" or "C", the dimensional changes of components responsive to the pressure changes will be sensed by the strain gauges 66 and 68. These strain related signals, which are in effect pressure related signals, are conducted via signal conductors 70 and 72 to wellhead mounted strain measurement devices 74 and 76. The output of the strain measurement devices 74 and 76 is then conducted to an appropriate receiver by a signal conductor 78 which is also referred to as an outer annulus monitor line or lines. Preferably, the receiver of the strain or pressure related signals will be located on or provided within a well monitoring system located at the personnel level of a production platform or other suitable facility. A strain gauge 80 is also mounted to the outer surface of the upper pressure containing housing that is coupled with the conductor pipe 12. Any pressure changes within the annulus "D" defined between the conductor pipe and the surface casing 18 will be conducted to a wellhead mounted strain measurement device 82 via a conductor or connector 84.

Referring now to FIG. 4, a further alternative embodiment of the present invention is shown in conjunction with a schematic illustration of a well system shown in section. The basic well system is substantially the same as presented in FIG. 1, thus like reference numerals appear for like components. The pressure monitoring system for the well includes a conventional production annulus pressure monitoring system as described above in connection with FIG. 1. In this case internal structure 86 of the wellhead, which can be fixed to or a component of the production tubing as shown, defines an annular external sealing surface 88. An inwardly facing annular sealing surface 90 may be defined by an upper portion of a housing of the production casing 26. A sliding sleeve element 92 is disposed in sealing engagement with the inwardly facing annular surface 90 and has a first position, shown at the right hand side of FIG. 4 for monitoring the pressure of annulus "A". The sliding sleeve element 92 is linearly moveable to a second position shown at the left hand side of FIG. 4 for monitoring the pressure of annulus "B". In its second position the sliding sleeve also establishes sealing engagement with the outwardly facing annular sealing surface 88 of the structure 86. The sliding sleeve is subject to movement hydraulically or by injected pressure, by an electrically controlled actuator or by any other suitable means. The sliding sleeve functions as a valve to control communication of a pressure measurement port which is in communication with annuli "A" and "B".

Referring now to FIG. 5, another alternative embodiment of the present invention is shown in conjunction with a schematic illustration of a well system shown in section. The basic well system is substantially the same as presented in FIG. 1, thus like reference numerals appear for like components. The pressure monitoring system for the well includes a conventional production annulus pressure monitoring system as described above in connection with FIG. 1. A pressure sensing line 94, which may be a passage, penetrates the pressure containing housing walls 16 and 22 and communicates with annulus "B" for sensing the pressure therein. The line or passage 94 is controlled by a valve 96 and communicates with an annulus monitor line 98 that is connected with the annulus pressure monitor line 44. Another line or passage 100 penetrates the pressure containing housing and the upper housing of the intermediate casing 18 and thus communicates with annulus "C" for sensing the pressure thereof. A valve 102 is used to control communication with the annulus "C" with the pressure sensing or monitor line 98, with other valves being closed so that the pressure of annulus "C" can be identified separately from the other annuli of the wellhead apparatus. Another line or passage 104 penetrates the conductor pipe or its upper housing section for pressure monitoring access to the annulus "D". A control valve 106 which is operated in conjunction with valves 96 and 102 enables the annulus pressure of annulus "D" to be independently monitored.

It should be borne in mind that the annuli pressure monitoring system of FIG. 5 is of intrusive character, though it provides a system for selectively monitoring the pressure of the various annuli "A", "B", "C" and "D", with the pressure of annulus "A" being monitored by the conventional system shown and described in connection with FIG. 1.

FIG. 6 presents another alternative embodiment of the present invention. In this case the well and wellhead system is shown schematically by way of sectional illustration as in the other Figures. The basic well system is substantially the same as presented in FIG. 1, thus like reference numerals appear for like components. The pressure monitoring system for the well includes a conventional production annulus pressure monitoring system as described above in connection with FIG. 1 and shown in FIGS. 2–5. In this case, only the pressure containing housing 13 at the upper end of the conductor pipe 12 is penetrated by a pressure monitoring conductor or passage 108 which is controlled by a valve 110 for monitoring the pressure of annulus "D", between the housing 13 and the surface casing 26. Pressure monitoring lines or passages 112 and 114 are located internally of the outer pressure containing housing 16 and are in communication respectively with annuli "B" and "C". At their upper ends, the annulus pressure monitoring passages 112 and 114 are provided with hydraulic couplers 116 and 118, enabling coupling thereof with pressure monitoring lines 120 and 122 respectively. Valves 124 and 126, which may be remotely controlled valves such as solenoid valves and controlled by the pressure monitoring system, of a production platform to permit selective detection of the pressure condition of the annuli in pressure communication with the passages 112 and 114. The valves may be controlled electrically, hydraulically or by any other suitable actuation system. Annuli pressure monitoring lines 128 and 130 are connected to the annuli pressure monitoring line 44 thus providing for selective monitoring of all of the annuli of the well and wellhead system by selective control of the various control valves of the pressure sensing lines.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for monitoring fluid pressure with a plurality of annuli of well and wellhead apparatus, comprising:

(a) providing a plurality of fluid pressure sensors within an outer pressure containing section of a wellhead each being located for sensing fluid pressure within a specific annulus;

(b) locating a pressure sensor interrogation system for receiving pressure responsive signals of said fluid pressure sensors externally of said outer pressure containing section of the wellhead;

(c) selectively interrogating said fluid pressure sensors causing selected fluid pressure sensors to generate a signal representative of the fluid pressure within a selected annulus at the time of interrogation;

(d) receiving the fluid pressure representative signal by said pressure sensor interrogation system; and (e) presenting the fluid pressure representative signal for inspection.

2. The method of claim 1, comprising:

transmitting said sensor interrogation signals and said pressure responsive sensor signals through wellhead wall structure.

3. The method of claim 1, comprising:

(a) locating said pressure sensor interrogation system externally of the outer pressure containing section of the wellhead; and (b) receiving annulus pressure representative signals of said fluid pressure sensors transmitted through the outer pressure containing section of the wellhead.

4. The method of claim 1, comprising:

(a) locating said pressure sensor interrogation system within the outer pressure containing section of the wellhead and externally of the annulus being monitored; and (b) receiving annulus pressure representative signals of said fluid pressure sensors transmitted through wellhead structure defining the annulus being monitored.

5. A non-invasive annuli monitoring system for monitoring well parameters within the annuli of a well and wellhead system, comprising:

(a) an outer pressure containing housing (b) an annuli monitoring system that is subject to inspection;

(c) a plurality of intelligent well data sensors each being exposed to the conditions present within an annulus of the well and wellhead system and each having the capability for transmitting data through wellhead structure; and (d) an intelligent sensor interrogation system for selectively interrogating said intelligent sensors and having the capability for transmitting interrogation signals through wellhead structure and for receiving data transmitted by said intelligent sensors, said intelligent sensor interrogation system having data communication with said annuli pressure monitoring system.

6. The non-invasive annuli monitoring system of claim 5, comprising:

(a) said annuli monitoring system having the capability for monitoring fluid pressure responsive signals and for presenting fluid pressure responsive signals for inspection;

(b) said intelligent well data sensors having the capability of sensing annulus pressure and for transmitting fluid pressure related signals through said outer pressure containing housing to said intelligent sensor interrogation system; and (c) said intelligent sensor interrogation system having the capability of receiving fluid pressure related signals of said intelligent well data sensors and communicating said fluid pressure related signals to said annuli monitoring system.

7. The non-invasive annuli monitoring system of claim 5, comprising:

said intelligent sensor interrogation system being located externally of said outer pressure containing housing and having the capability for transmitting sensor interrogation signals through said outer pressure containing housing to said intelligent sensors.

8. The non-invasive annuli monitoring system of claim 5, comprising:

said intelligent sensor interrogation system being located internally of said outer pressure containing housing and having the capability for transmitting sensor interrogation signals through well and wellhead structure to said intelligent sensors.

* * * * *

UNITED STATES PATENT AND TRADEMARK OFFICE

CERTIFICATE OF CORRECTION

PATENT NO. : 6,513,596 B2 
DATED : February 4, 2003
INVENTOR(S) : Wester

It is certified that error appears in the above-identified patent and that said Letters Patent is hereby corrected as shown below:

Column 3,
Line 52, delete “on/all”, insert -- on all --

Column 4,
Line 27, delete “a/multi-annulus”, insert -- a multi-annulus --
Line 28, delete “pressure-monitoring”, insert -- pressure monitoring --

Signed and Sealed this

Twelfth Day of August, 2003

JAMES E. ROGAN
*Director of the United States Patent and Trademark Office*